US006438872B1

(12) United States Patent
Chil et al.

(10) Patent No.: US 6,438,872 B1
(45) Date of Patent: Aug. 27, 2002

(54) EXPANDABLE SHOE AND SHOE ASSEMBLIES

(75) Inventors: Kwon Dong Chil, Pusan (KR); Harry Miller, Weston, MA (US)

(73) Assignee: Harry Miller Co., Inc., Boston, MA (US)

( * ) Notice: Subject to any disclaimer, the term of this patent is extended or adjusted under 35 U.S.C. 154(b) by 0 days.

(21) Appl. No.: 09/438,935

(22) Filed: Nov. 12, 1999

(51) Int. Cl.[7] ..... A43B 3/26; A43B 1/10; A43D 1/00

(52) U.S. Cl. ..... 36/97; 36/102; 36/8.4

(58) Field of Search ..... 36/97, 88, 93, 36/102, 8.4

(56) References Cited

U.S. PATENT DOCUMENTS

| | | | | |
|---|---|---|---|---|
| 524,946 | A | 8/1894 | Kregel | |
| 526,626 | A | 9/1894 | Kregel | |
| 797,966 | A | 8/1905 | Lange et al. | |
| 831,210 | A | 9/1906 | Bosley | |
| 1,539,762 | A | 5/1925 | Mussabini | |
| 1,633,413 | A | 6/1927 | Marca | |
| 1,856,377 | A | 5/1932 | Dettelbach | |
| 2,009,684 | A | 7/1935 | Affronte | |
| 2,112,052 | A | 3/1938 | Smith | |
| 2,113,898 | A | 4/1938 | Nehus | |
| 2,295,364 | A | 9/1942 | Skorepa | |
| 2,603,889 | A | 7/1952 | Lahnstein et al. | |
| 2,734,284 | A | 2/1956 | Seurbom | |
| 2,825,109 | A | 3/1958 | Nelson | |
| 3,008,250 | A | 11/1961 | Herunter | |
| 3,057,085 | A | 10/1962 | Rigsby | |
| 3,389,481 | A | 6/1968 | England | |
| 3,431,658 | A | 3/1969 | Finn | |
| 3,436,842 | A | 4/1969 | Sachs | |
| 3,541,708 | A | 11/1970 | Rosen | |
| 3,618,235 | A | 11/1971 | Cary, Jr. | |
| 3,668,791 | A | 6/1972 | Salzman et al. | |
| 3,686,777 | A | 8/1972 | Rosen | |
| 3,738,027 | A | 6/1973 | Schoch | |
| 3,748,756 | A | 7/1973 | White | |
| 3,771,529 | A | 11/1973 | Matteson | |
| 3,794,037 | A | 2/1974 | Matteson | |
| 3,808,644 | A | 5/1974 | Schoch | |
| 3,834,048 | A | 9/1974 | Maurer | |
| 3,883,964 | A | 5/1975 | Check | |
| 3,922,800 | A | 12/1975 | Miller et al. | |
| 3,965,544 | A | 6/1976 | Boden | |
| 3,997,985 | A | 12/1976 | Shiina | |
| 4,060,918 | A | * 12/1977 | Mandel | 36/97 |
| 4,083,128 | A | 4/1978 | Rossman | |
| 4,120,103 | A | 10/1978 | Colby | |
| 4,136,468 | A | 1/1979 | Munschy | |
| 4,166,329 | A | 9/1979 | Herbig | |
| 4,178,925 | A | 12/1979 | Hirt | |
| 4,192,087 | A | 3/1980 | Salomon | |
| 4,299,039 | A | 11/1981 | Hanson | |
| 4,360,979 | A | 11/1982 | Spademan | |

(List continued on next page.)

FOREIGN PATENT DOCUMENTS

| | | | |
|---|---|---|---|
| CA | 2201816 | 10/1998 | |
| DE | 59 317 C | 10/1891 | |
| FR | 2752369 | 2/1998 | |
| WO | WO 92/18023 | * 10/1992 | 36/97 |
| WO | WO 96 28053 | 9/1996 | |

*Primary Examiner*—Anthony Stashick
(74) *Attorney, Agent, or Firm*—Hale and Dorr LLP

(57) ABSTRACT

An expandable shoe and last board are disclosed. For the shoe, a front outer assembly and a rear outer assembly are attached to a flexible, expandable segment. An adjustable inner assembly has a manually urgable control to adjust a dimension of the inner assembly and thereby a corresponding dimension of the shoe. A visualization window may be used to provide a view port to the inner assembly to see the adjustment of a shoe dimension.

24 Claims, 12 Drawing Sheets

U.S. PATENT DOCUMENTS

| | | | | | |
|---|---|---|---|---|---|
| 4,379,370 | A | | 4/1983 | Balbinot | |
| 4,426,796 | A | | 1/1984 | Spademan | |
| 4,433,456 | A | | 2/1984 | Baggio | |
| 4,523,395 | A | | 6/1985 | Borsoi | |
| 4,551,932 | A | | 11/1985 | Schoch | |
| 4,553,342 | A | | 11/1985 | Derderian et al. | |
| 4,615,127 | A | | 10/1986 | Delery | |
| 4,616,524 | A | | 10/1986 | Bidoia | |
| 4,619,058 | A | | 10/1986 | Gumbert | |
| 4,633,599 | A | | 1/1987 | Morell et al. | |
| 4,653,204 | A | | 3/1987 | Morell et al. | |
| 4,680,878 | A | | 7/1987 | Pozzobon et al. | |
| 4,719,670 | A | | 1/1988 | Kurt | |
| 4,719,709 | A | | 1/1988 | Vaccari | |
| 4,719,710 | A | | 1/1988 | Pozzobon | |
| 4,731,940 | A | | 3/1988 | Zanatta et al. | |
| 4,748,726 | A | | 6/1988 | Schoch | |
| 4,754,560 | A | | 7/1988 | Nerrinck | |
| 4,765,070 | A | | 8/1988 | Chemello et al. | |
| 4,799,297 | A | | 1/1989 | Baggio et al. | |
| 4,841,649 | A | | 6/1989 | Baggio et al. | |
| 4,858,341 | A | | 8/1989 | Rosen | |
| 4,884,760 | A | | 12/1989 | Baggio et al. | |
| 4,907,354 | A | | 3/1990 | Benoit et al. | |
| 4,937,952 | A | | 7/1990 | Olivieri | |
| 4,937,953 | A | | 7/1990 | Walkhoff | |
| 4,942,678 | A | | 7/1990 | Gumbert | |
| 4,944,099 | A | | 7/1990 | Davis | |
| 4,949,479 | A | | 8/1990 | Ottieri | |
| 4,961,544 | A | | 10/1990 | Bidoia | |
| 4,967,492 | A | | 11/1990 | Rosen | |
| 4,969,277 | A | | 11/1990 | Williams | |
| 4,998,358 | A | | 3/1991 | Girardelli | |
| 5,036,604 | A | | 8/1991 | Rosen | |
| 5,042,177 | A | | 8/1991 | Schoch | |
| 5,060,402 | A | | 10/1991 | Rosen | |
| 5,062,224 | A | | 11/1991 | Tacchetto | |
| 5,079,858 | A | | 1/1992 | Sartor et al. | |
| 5,113,599 | A | | 5/1992 | Cohen et al. | |
| 5,117,567 | A | | 6/1992 | Berger | |
| 5,157,813 | A | | 10/1992 | Carroll | |
| 5,158,767 | A | | 10/1992 | Cohen et al. | |
| 5,177,882 | A | | 1/1993 | Berger | |
| 5,181,331 | A | | 1/1993 | Berger | |
| 5,205,055 | A | | 4/1993 | Harrell | |
| 5,224,280 | A | * | 7/1993 | Preman et al. | 36/27 |
| 5,241,762 | A | | 9/1993 | Rosen | |
| 5,265,349 | A | | 11/1993 | Munschy | |
| 5,285,584 | A | | 2/1994 | Dubner | |
| 5,291,671 | A | | 3/1994 | Caberlotto et al. | |
| 5,319,868 | A | | 6/1994 | Hallenbeck | |
| 5,325,613 | A | | 7/1994 | Sussmann | |
| 5,325,614 | A | | 7/1994 | Rosen | |
| 5,327,662 | A | | 7/1994 | Hallenbeck | |
| 5,333,398 | A | | 8/1994 | Seo | |
| 5,341,583 | A | | 8/1994 | Hallenbeck | |
| 5,345,697 | A | | 9/1994 | Quellais | |
| 5,351,710 | A | | 10/1994 | Phillips | |
| 5,355,596 | A | | 10/1994 | Sussmann | |
| 5,381,609 | A | | 1/1995 | Hieblinger | |
| 5,384,970 | A | | 1/1995 | Melton | |
| 5,404,658 | A | | 4/1995 | Rosen | |
| 5,408,761 | A | | 4/1995 | Gazzano | |
| 5,437,110 | A | * | 8/1995 | Goldston et al. | 36/27 |
| 5,459,949 | A | | 10/1995 | MacPhail | |
| 5,467,537 | A | | 11/1995 | Aveni et al. | |
| 5,502,902 | A | | 4/1996 | Sussmann | |
| 5,511,325 | A | | 4/1996 | Hieblinger | |
| 5,570,523 | A | | 11/1996 | Lin | |
| 5,599,088 | A | * | 2/1997 | Chien | 36/137 |
| 5,600,874 | A | | 2/1997 | Jungkind | |
| 5,657,557 | A | | 8/1997 | Hull et al. | |
| 5,659,980 | A | | 8/1997 | Lin | |
| 5,678,325 | A | | 10/1997 | Davidowitz et al. | |
| 5,682,687 | A | | 11/1997 | Arai | |
| 5,699,629 | A | | 12/1997 | Munschy | |
| 5,709,954 | A | | 1/1998 | Lyden et al. | |
| 5,729,912 | A | | 3/1998 | Gutkowski et al. | |
| 5,737,854 | A | | 4/1998 | Sussmann | |
| 5,791,021 | A | | 8/1998 | James | |
| 5,791,068 | A | | 8/1998 | Bernier et al. | |
| 5,794,362 | A | * | 8/1998 | Polk, III et al. | 36/97 |
| 5,809,620 | A | | 9/1998 | Crowley et al. | |
| 5,813,146 | A | * | 9/1998 | Gutkowski et al. | 36/97 |
| 6,045,144 | A | * | 4/2000 | Wong | 36/97 |
| 6,189,239 | B1 | * | 2/2001 | Gasparovic et al. | 36/102 |

* cited by examiner

ALONG C-C'

ALONG B-B'

ALONG A-A'

ALONG B-B'

EXPANDABLE SHOE AND SHOE ASSEMBLIES

BACKGROUND OF THE INVENTION

1. Technical Field

The present invention relates to expandable shoes that may be adjusted longitudinally.

2. Discussion of Related Art

Some attempts have been made to provide expandable shoes, which can purportedly withstand day-to-day use. U.S. Pat. No. 3,389,481, for example, discloses a shoe in which a two plate assembly is disposed between an inner and a disjointed outer sole, having overlapping front and back portions. One of the plates includes a spring tongue, and the other plate includes two apertures to receive the spring tongue, each aperture corresponding to a shoe size. To adjust the shoe size, a screw which extends through the heel and into the disjointed soles is removed. The shoe may then be pulled apart allowing the disjointed sole to separate until the spring tongue engages the next aperture. Thus the shoe size may be lengthened by one size, but apparently the size cannot be controlled finely or reduced. The shoe includes two crinkled leather portions 34, one on each side of the shoe, to facilitate expansion of the shoe.

SUMMARY

Under one aspect of the present invention, a shoe includes a front outer assembly an d a rear outer assembly. A flexible, expandable segment is attached to the front and rear outer assemblies to define a shoe outer shell. The flexible segment extends at least partially along each side of the outer shell and transversely across the bottom of the outer shell. Within the outer shell an adjustable inner assembly is disposed and attached to the front and rear outer assembly. The inner assembly has a control to adjust a dimension of the inner assembly and thereby a corresponding dimension of the shoe.

Under another aspect of the invention related to the above aspect, the inner assembly may be in the form of a last board, or as a combination of a last board and other portions of the shoe, for example, a portion of a midsole.

Under one aspect of the invention, a visualization window provides a view port to the inner assembly. The inner assembly may include size markings or other indicia representative of a shoe adjustment, and these markings may be placed on the inner assembly to allow them to be visible through the view port.

Under another aspect of the invention, the inner assembly indudes a first sole portion, a second sole portion, and a screw drive. The screw drive has an externally accessible screw passing through a screw insert mounted to one of the first and second sole portions and a screw-receiving portion attached to the other of the first and second sole portions. In this fashion, turning the screw causes the first and second portions to move relative to one another, thereby adjusting a dimension of the shoe.

Under still another aspect of the invention, the inner assembly includes a first sole portion and a second sole portion. The first portion is shaped for relative slidable engagement with the second portion. A manually urgable member is accessible from the outer shell, and it is in engageable and releasable communication with an engagement member, fixed to one of the first and second sole portions. When the urgable member is released from the engagement member, the first and second sole portions may be moved to adjust a dimension of the shoe and when the urgable member is in engagement with the engagement member the first and second portions resist sidable movement relative to one another.

Under another aspect of the invention related to the above, the urgable member includes a deformable biasing segment, which biases a toothed member attached to the urgable member into engagement with the engagement member, which has teeth facing the toothed member. When the urgable member is released, the toothed member and the teeth of the engagement member interlock causing the shoe portions to attain a locked state. When the urgable member is urged against the biasing forces of the biasing segment, the teeth release with respect to one another and the shoe portions attain an unlocked state allowing slidable movement and thereby adjustment of a shoe dimension.

The principles of the invention may be realized in hiking shoes, dress shoes, sandals, biking shoes, Nordic and cross-country ski-boots and the like.

Under another aspect of the invention, an expandable hooked eyelet assembly indudes two relatively movable pieces.

BRIEF DESCRIPTION OF THE DRAWING

In the Drawing,

FIG. 3 is a cross-sectional view of an exemplary embodiment of the

DETAILED DESCRIPTION

Figure 1A:
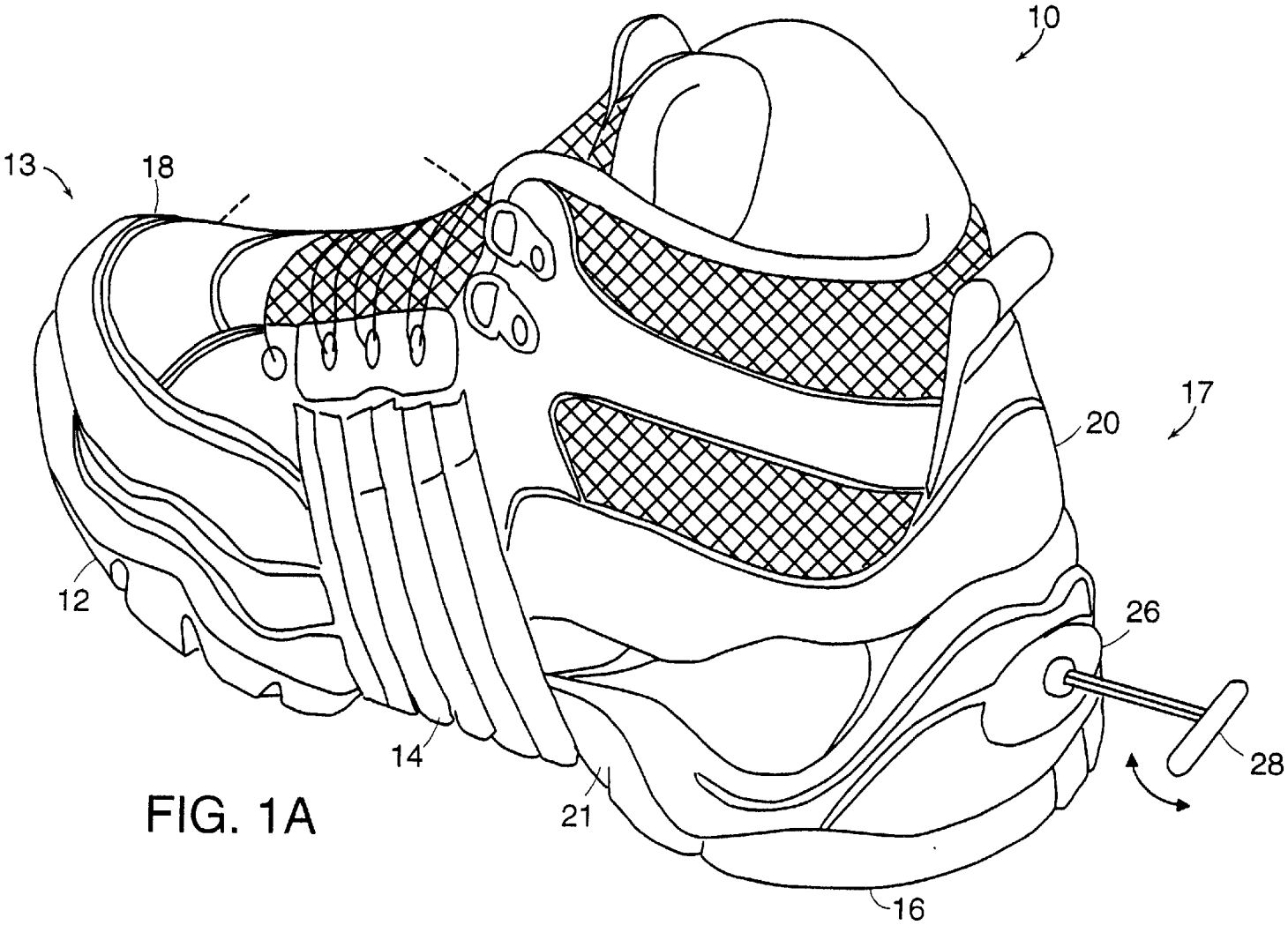
FIG. 1A is a perspective view of an exemplary embodiment of the invention.
Figure 1B:
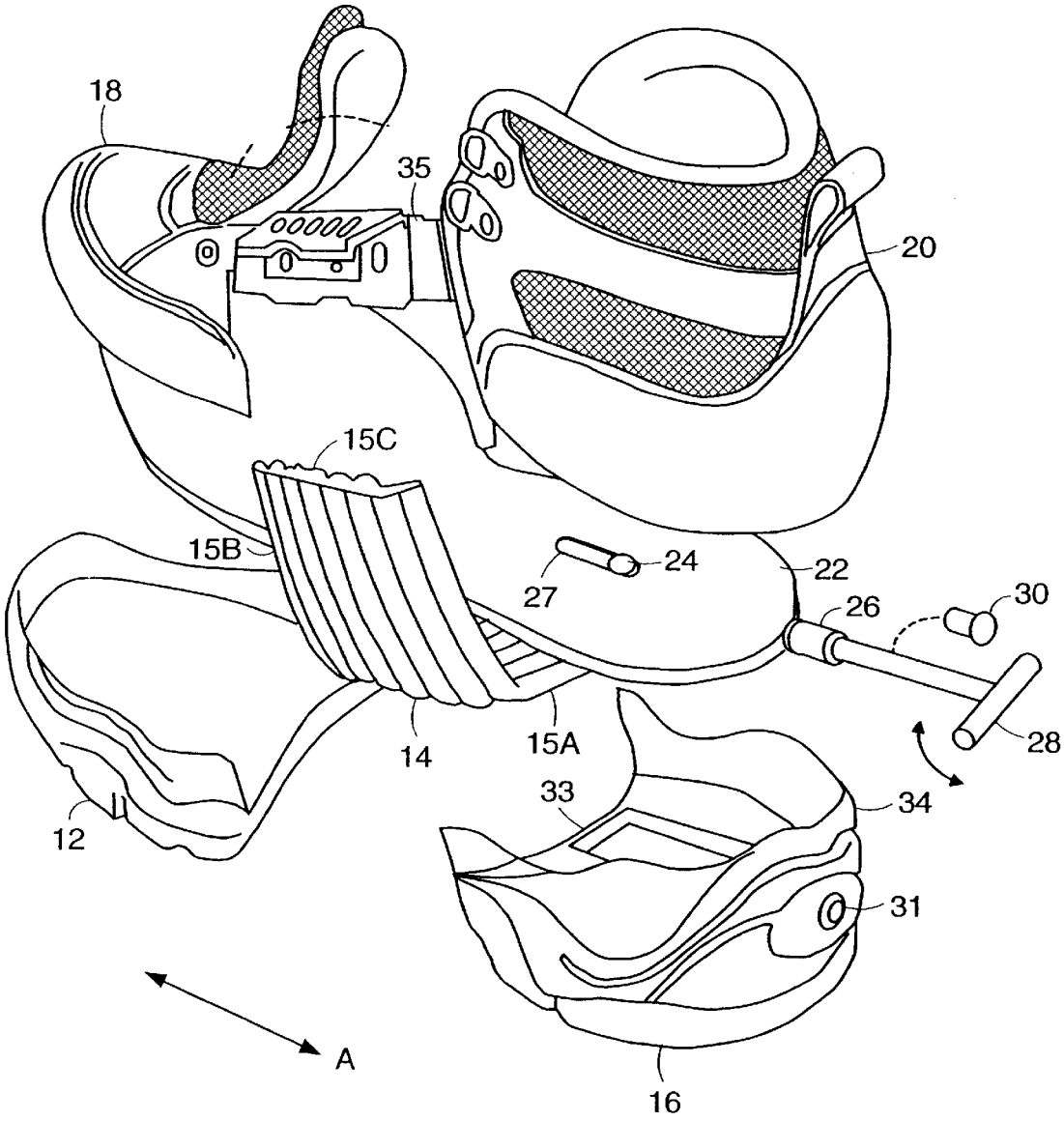
FIG. 1B is an exploded view of an exemplary embodiment of the invention.

FIGS. 1A–B show an exemplary embodiment in perspective and exploded views. Shoe 10 includes a front outer sole 12 and a front upper 18 to form a front outer assembly 13, and a rear outer sole 16 and a rear upper 20 to form a rear outer assembly 17. The front outer assembly 13 is attached to one edge 15B of a bellows segment 14, and the rear outer assembly 17 is attached to a second edge 15A, in each case using conventional techniques, such as by using stitching to the uppers 18, 20 and glue along the outer soles 12, 16. The combination of front outer assembly 13, rear outer assembly 17, and bellows segment 14 forms an outer shell 21.

An adjustable inner sole assembly 22 is placed within outer shell 21 so that a screw 26 extends through a screw port opening 31 of the rear outer sole 16. The inner assembly 22 is firmly attached to the front and rear outer assemblies 13,17 but not to bellows 14. In this fashion, once the shoe is assembled and in use, a wrench 28 (e.g., with an allen-head design) may be used to turn a screw 26 to adjust the length of the inner sole assembly 22 (and correspondingly the entire shoe 10) in the direction A. A control feature 24 (more below) is positioned within guide slot 27 to facilitate the directional control of the shoe 10 as it is caused to expand or contract. Screw port plug 30 may be used to fit within screw port opening 31 to cover the screw 26 when the shoe is not being adjusted. To adjust the size of this embodiment, only the screw 26 needs to be turned. The size may be lengthened or shortened in fine increments corresponding to the pitch of the screw 26.

Figure 1C:
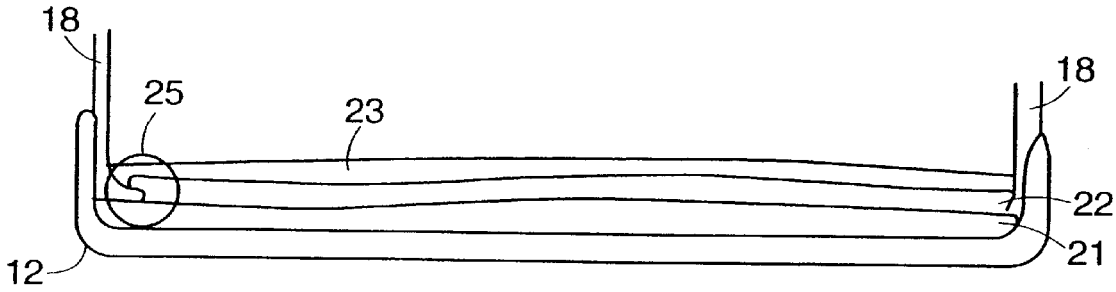
FIG. 1C is a transverse cross-section of an exemplary embodiment of the invention.

FIG. 1C shows a transverse cross section of an assembled shoe. Not shown in FIGS. 1A–B, but shown here, are the inclusion of a midsole 21 and an inner sole 23. At area 25 the upper 18 is joined to the inner assembly 22 by glue or stitching. Analogous joinery may be used at a rear portion of the shoe. The inner sole 23 is conventional and the midsole may be conventional in embodiments using a last board or may be modified to form all or a portion of the inner assembly 22. This figure will illustrate to those skilled in the art, the simplicity of integrating the features of inner assembly 22 into the midsole or leaving it as a last board left in the shoe. Such integration is largely dictated by the type of shoe into which the principles of the invention will be realized, e.g., hiking shoes, dress shoes, biking shoes, ski boots, sandals and the like. Likewise, the stiffness of the last board and/or the midsole is dictated by the shoe type.

The front and rear outer soles 12, 16 may be made with conventional techniques and material to obtain popular shoe constructions. The front sole 12 may be made so that it is roughly only a front half of a shoe sole, and the rear outer sole 16 may be made so that it is only approximately a rear half of a sole. The rear outer sole, unlike conventional soles, is also made to define a screw port opening 31 and a generally rectangular recess 33 (see FIG. 1B) in the heel portion 34. (As will be described below, the recess 33 receives a portion of the inner sole assembly 22.) Analogously, the front and rear uppers 18, 20 may be made using conventional techniques and materials to obtain popular shoe appearances.

Bellows segment 14 is made of a stretchable material, e.g., rubbers, press coated fabrics, etc., and fashioned (e.g., molded or extruded) as a bellows in a generally rectangular segment, which is then shaped into the U-shape, extending along the sides and bottom of the shoe 10 as shown in FIG. 1B. The bellows segment 14 includes flat edges 15A, B opposite each other which is used in attaching the bellows 14 to the uppers 18,20 and outer soles 12, 16. In the illustrated embodiment, edge 15C and a corresponding unshown edge opposite 15C are attached to expandable eyelet assemblies 35, described below.

Figure 2:
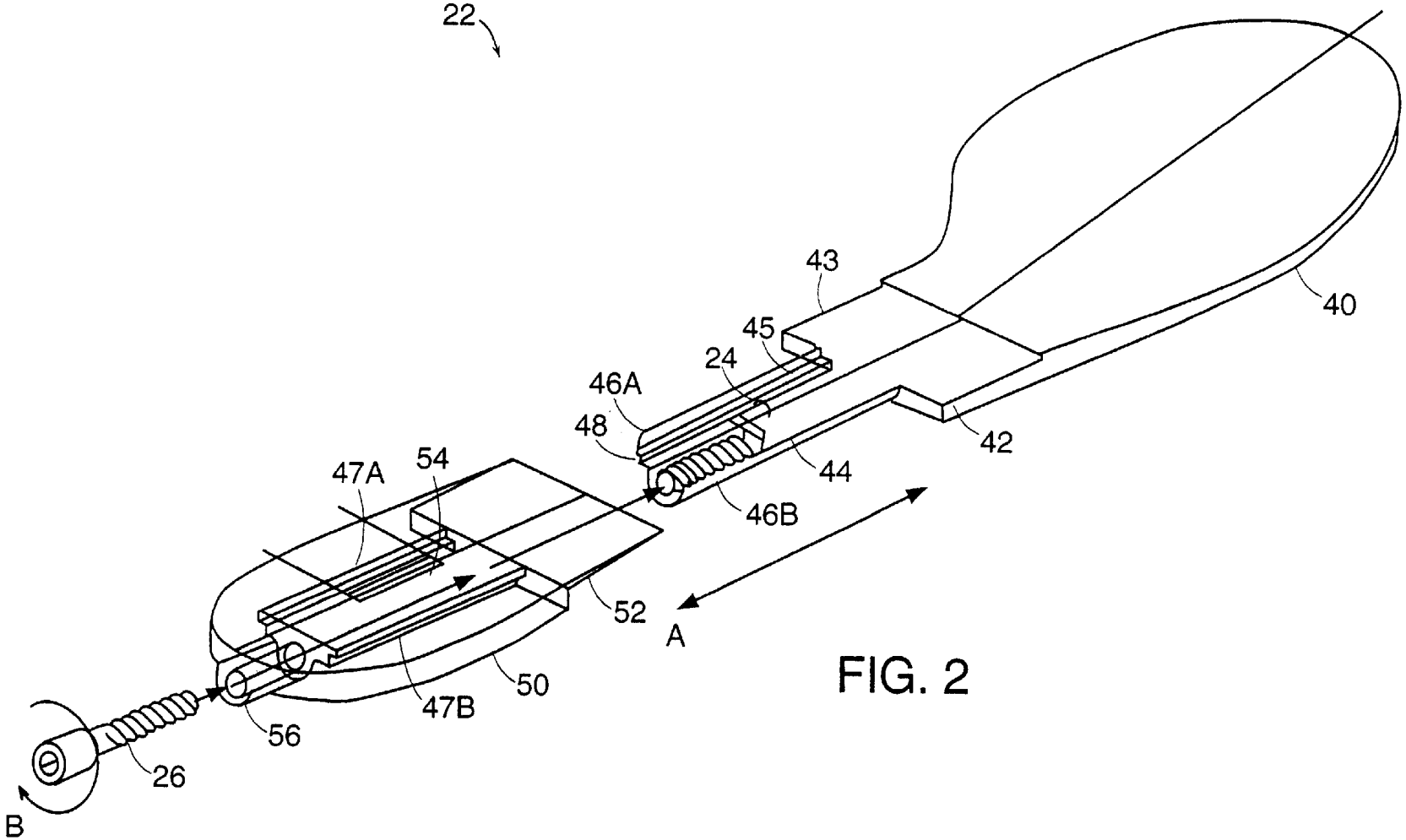
FIG. 2 is an exploded view of an adjustable inner sole assembly of an exemplary embodiment of the invention.

FIG. 2 shows an exploded view of adjustable inner assembly 22. The inner assembly 22 includes a front section 40 and a rear section 50. The top surface of each section is generally flat but may be shaped with slight curvature found in conventional designs. Viewing the sections 40, 50 from above, each section is cut according to a conventional inner sole pattern, except that each section respectively corresponds to approximately a front or rear half of an inner sole. Conventional materials may be used in fabricating the sections 40,50, for example, through injection molding or analogous techniques.

A front adjustment member 42 may be attached to or integrated with front section 40. Front adjustment member 42 includes a generally flat section 43 and includes an elongated section 44 having a generally rectangularly shaped top portion 45 with wing-like extensions 46A and B. As will be explained below, wing-like extensions 46 A and B are shaped to fit corresponding grooves 47A and B, within rear section 50. On the underside of elongated section 44 is a threaded screw-receiving section 48 that extends parallel to the longitudinal centerline of the front section 40, but which is offset from the top surface of front section 40. On the top side of the elongated section 44 is a control guide 24 protruding slightly upward and substantially on the longitudinal centerline of the front section 40. This guide 24 may be made in numerous ways, including for example, using rivets or integrating the shape into the design of member 42.

The rear section 50 is shaped on its underside to have a first hollowed segment 52 and a second hollow segment 54, more rearward than the first. The first segment 52 mates with flat section 43 of the front section 40, and the second segment 54 is shaped to receive the top portion 45 of the front section 40. Second hollow segment 54 includes longitudinal grooves 47 A,B shaped to receive wing-like extensions 46A,B of front section 40. The rear section 50 also includes a screw section insert 56 for receiving and guiding screw 26 into alignment with screw-receiving section 48. The rear section 50 includes guide slot 27 along the longitudinal centerline of rear section 50 and through which the guide 24 is positioned once the inner assembly 22 is configured. As is readily apparent, for right-handed screws, once the screw 26 engages threads in hole 48, rotating screw 26 clockwise B will draw front section 40 closer to rear section 50, and vice-versa.

Figure 3:
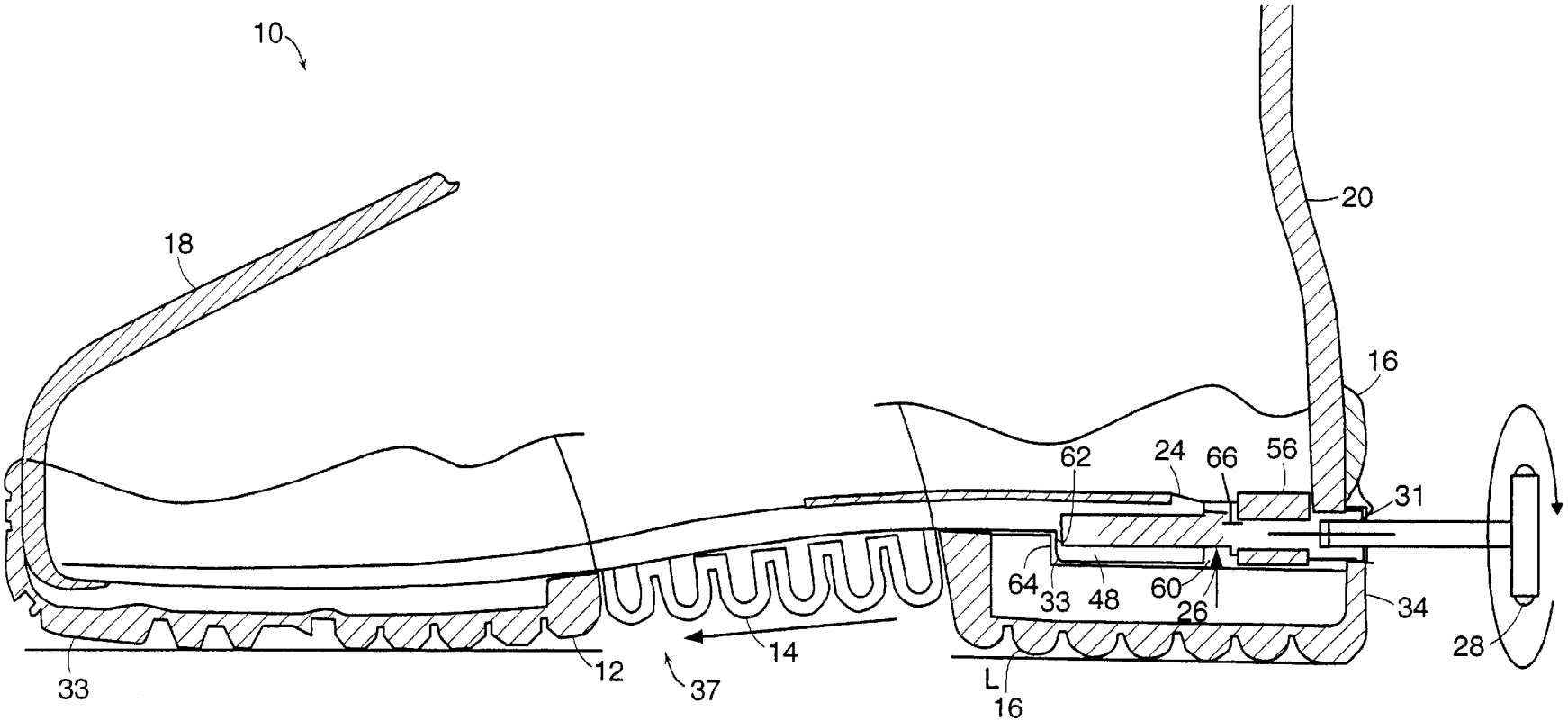

FIG. 3 is a cross-sectional, longitudinal view of shoe 10. For clarity of illustration, portions of the front section 40 and rear section 50 are not shown. As shown in FIG. 3, screw-receiving section 48 is positioned to fit within recess 33 of heel 34 of rear outer sole 16. The recess 33 has a longitudinal length sufficient to allow section 48 to be moved longitudinally therein, thus allowing for adjustment of the shoe. When the distal edge 60 of section 48 abuts insert 56, the shoe is at the smallest adjustment size. When the front edge 62 of section 48 abuts the front edge 64 of recess 33, the shoe is at its largest size. The size adjustments between smallest and largest are controlled by turning screw 26 and the granularity of the adjustment is only limited by the pitch of the screw 26. A clip 66 prevents screw 26 from becoming disengaged with section 48 and becoming dislodged from the shoe 10.

FIG. 3 also shows that the design of the soles 12, 16 may be made to provide a raised arch area 37 where the bellows segment 14 resides. The arch area is sufficiently raised from the wear surface 38 so that the exterior surface of the bellows segment 14 should not contact the ground. By having a raised area 37, the bellows 14 may be one continuous piece extending along the sides and bottom of the show, facilitating good sealing at the expandable portion of the outer shell 21.

Figure 4B:
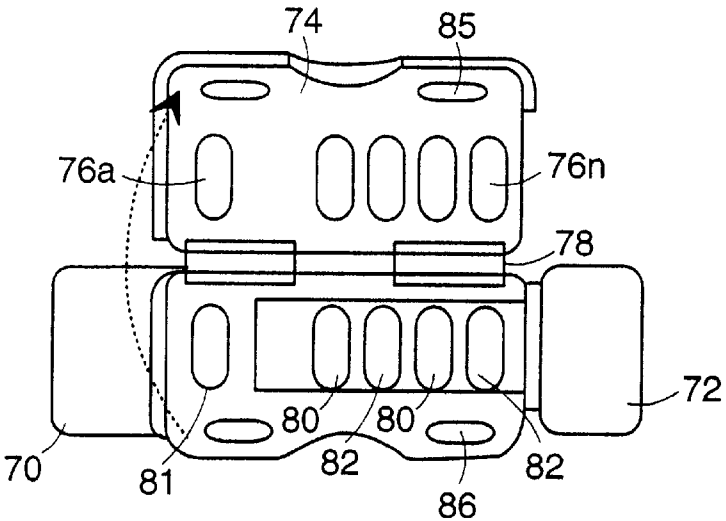
FIGS. 4A and 4B show an expandable eyelet assembly according to an exemplary embodiment.
Figure 4A:
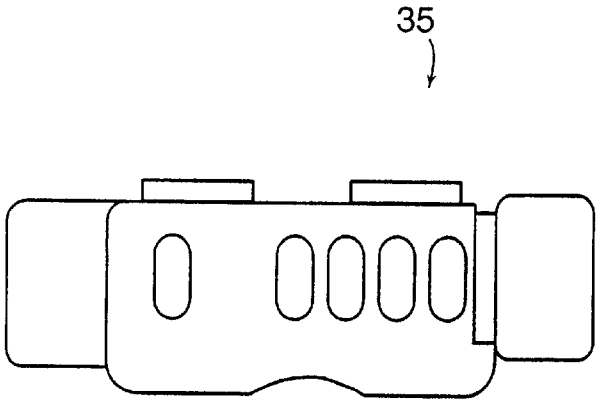

FIGS. 4A–B show an expandable eyelet assembly 35 in a closed state (FIG. 4A) and an open state (FIG. 4B). The eyelet assembly may be made using conventional polymeric materials and using conventional techniques. The assembly includes a first piece 70 and second piece 72. The first piece 70 includes an integrated flap 74 having a series of grooves 76*a–n*. The flap 74 may open and close due to the flexibility of the materials and to the integrated hinge-like members 78. The first piece has shaped therein a rectangular recess (not shown) to at least partially receive the second piece 72. It also includes a raised hooked eyelet 81 that is in alignment with groove 76*a* of flap 74. The second piece 72 is generally rectangularly shaped to fit into the corresponding recess of first piece 70 and it includes raised hooked eyelets 80 and raised alignment members 82. When in the open state, the first and second pieces 70,72 may be moved longitudinally relative to one another to adjust the eyelets' 80 alignment with the grooves 76*a–n*. Once aligned as desired, flap 74 is closed and locked with protruding detente 85 engaging corresponding slots 86 in first piece 70. First piece 70 may be sewn to front outer assembly 13, and second piece 72 may be sewn to rear outer assembly 17. Both pieces 70,72 may also be attached to bellows 14 directly or attached to another segment such as a nylon segment which in turn is attached to bellows 14.

Figure 4D:
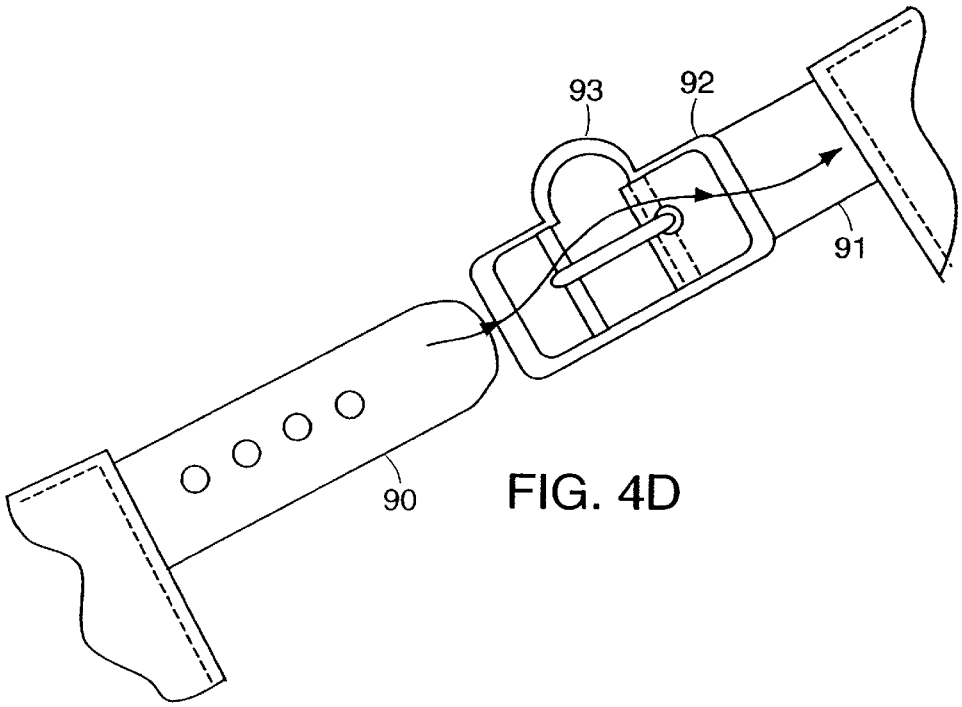
FIG. 4D shows an exemplary show using the eyelet assemebly of FIG. 4C.
Figure 4C:
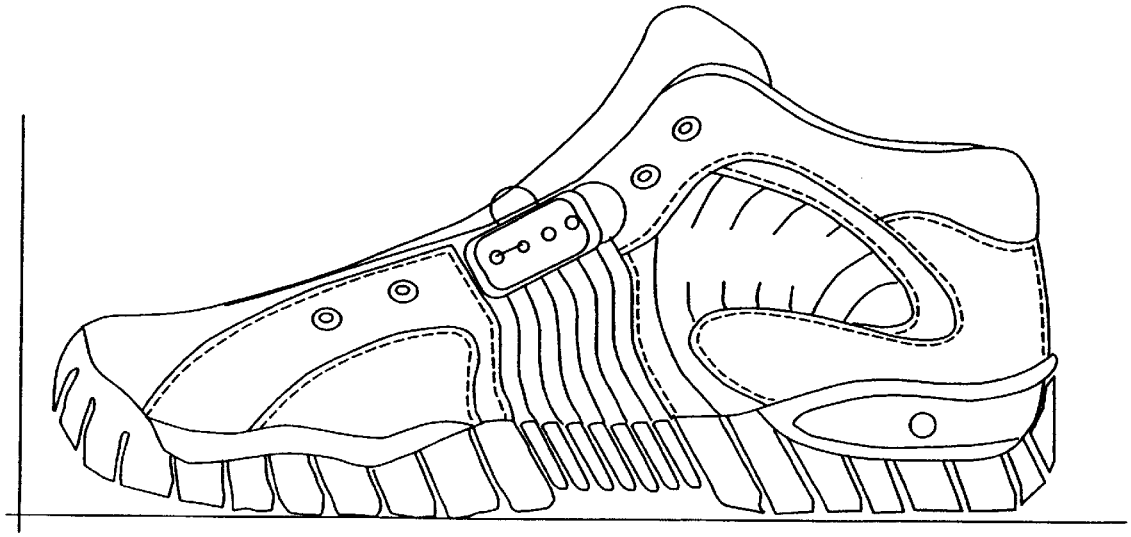
FIG. 4C shows an expandable eyelet assembly according to one embodiment of the invention.

FIGS. 4C–D show another embodiment in which belt sections 90,91 are connected with buckle 92. Buckle 92 includes a curved portion 93 which may act as an eyelet. Another embodiment (for which a figure is not necessary) does not use eyelet assembly 35 and instead simply uses ringed eyelets within bellows 14 or within a stretchable material attached to bellows 14.

Figure 5:
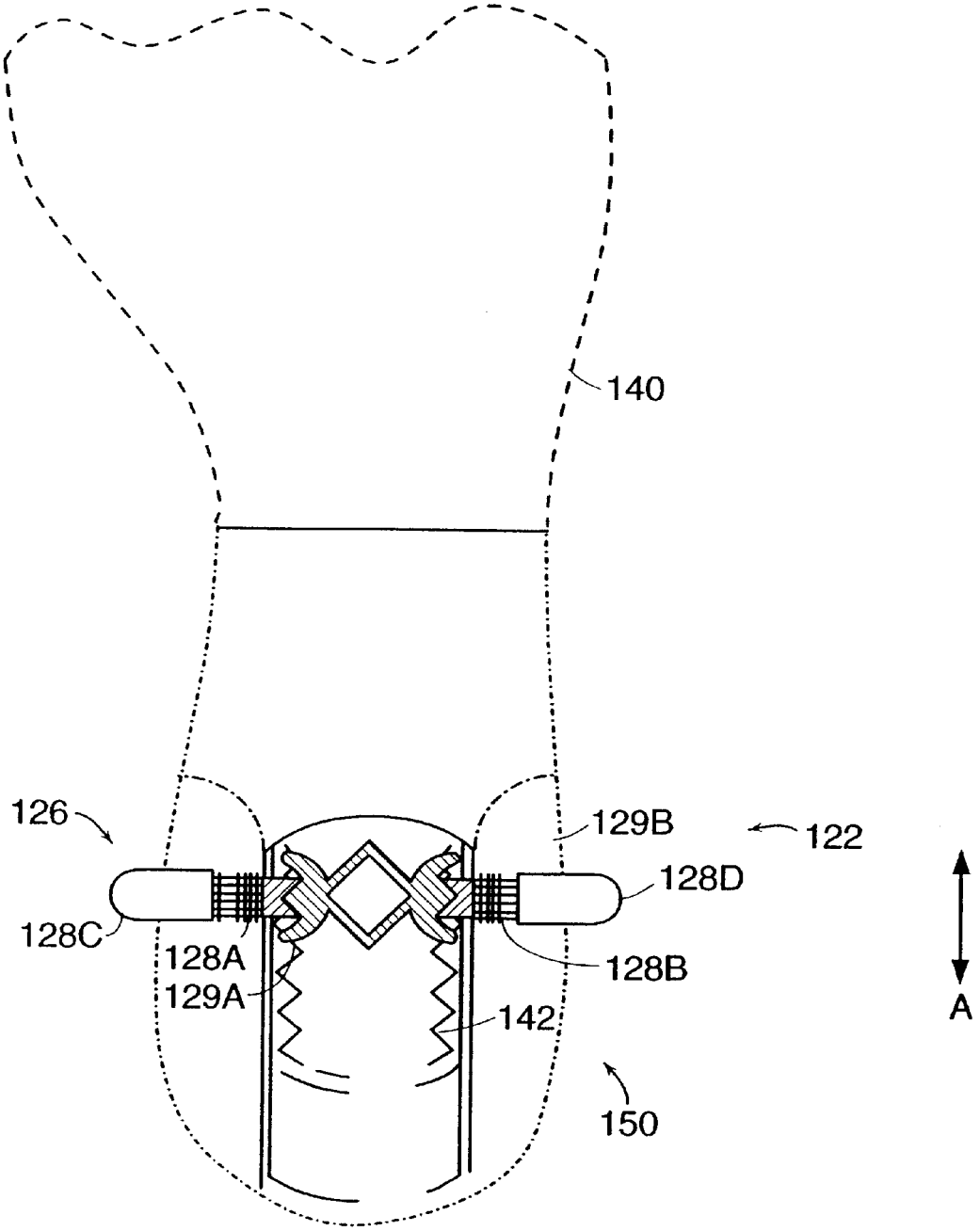
FIGS. 5–8B are plan and cross-sectional views of an adjustable inner assembly of one embodiment of the invention.

FIG. 5 shows a plan, underside view of an alternative inner assembly 122, which may be substituted for assembly 22. In this embodiment, inner sole assembly 122 includes a front section 140, a rear section 150, and a control mechanism 126. As will be explained more fully below, control mechanism 126 is in a locked state in its natural state. By urging pins 128A,B inward, the control mechanism unlocks and the front section 140 and rear section 150 may be moved relative to each other along line A, thereby allowing adjustment of a dimension of the shoe.

Figure 6A:
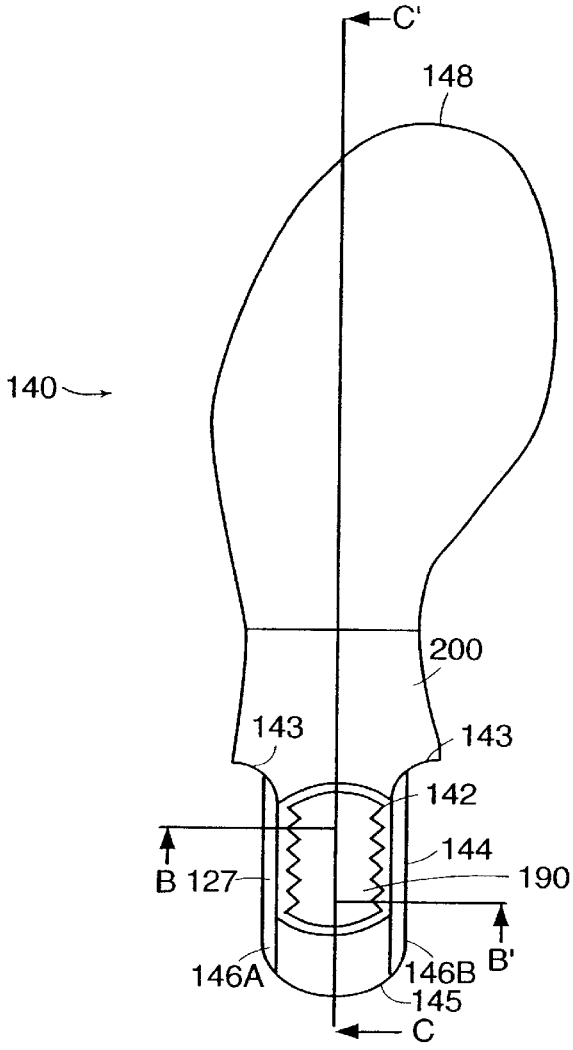
Figure 6C:
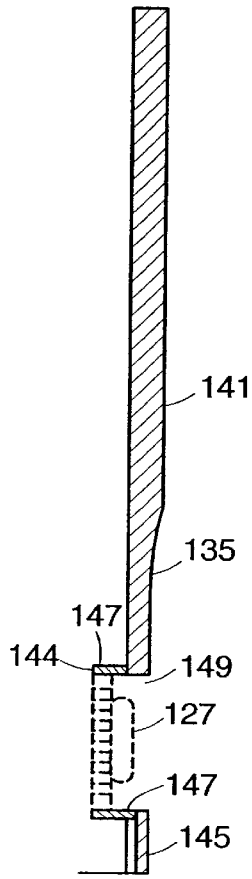
Figure 6B:
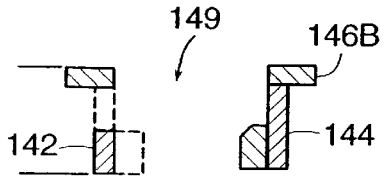

Referring to FIGS. 6A–C, the front section 140 is shown in more detail with an underside view. Front section 140 defines a front portion of a conventionally-shaped sole, extending from a toe portion 148 to arcuate portions 143 and then to heel section 144. The front section 140 is generally planar, except that a first heel section 144 is offset below top surface 141 by vertical members 147 and in substantially parallel relation to top surface 141. Section 144 includes raised, wing-like members 146 A,B extending transversely along the edges of section 144 and defines a chamber 149 with toothed longitudinal walls 142. Slot 127 is defined in each wall 142 and, as will be explained below, allows a portion of control mechanism 126 (see FIG. 5) to pass therethrough. At an end opposite toe portion 148 is a heel portion 145 which is generally planar with top surface 141.

Figure 7C:
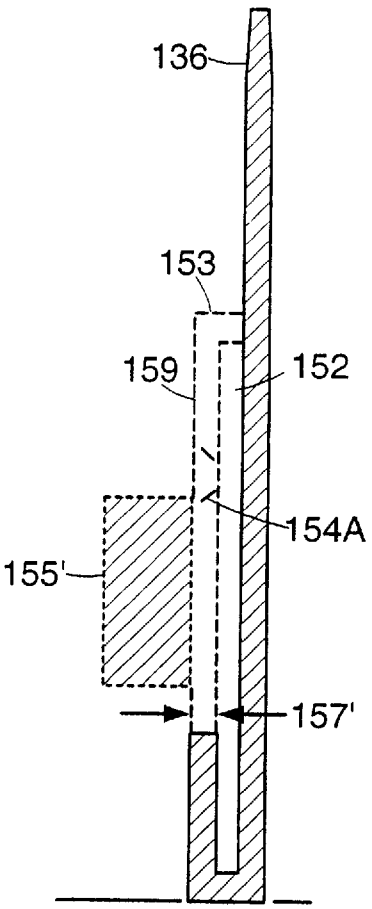
Figure 7A:
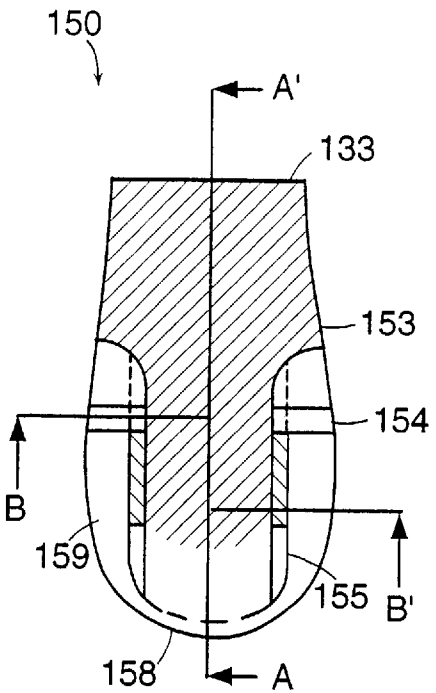
Figure 7B:
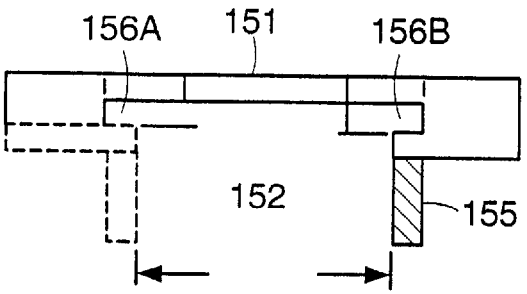

FIGS. 7A–C show a bottom, plan view of the rear section 150 in more detail. Rear section 150 defines a rear portion of a conventionally-shaped inner sole, extending from a heel portion 158 to edge 133. Rear section 150 defines a cavity 152 which receives rectangular portion 144 so that grooves 156 A,B receive wing-ike edges 146 A,B, and so that curved ridge section 158 receives heel portion 145 of front section 140. When the front section 140 is fully received in rear section 150, a top portion 151 of rear section 150 will lay on top of the received portion of the front section 140, and the arcuate sections 153 of the rear section 150 will mate with the arcuate sections 143 of the front section 140. The underside surface 136 of the top portion 151 is shaped to also mate with the upper surface 135 of the front section 140 (see FIG. 6C). Openings 154 are defined in a downwardly extending insert member 155 shaped to fit in recess 33 of the shoe (see FIG. 3). The openings 154 allow a portion of control mechanism 126 (see FIG. 5) to pass therethrough. Semi-circular recesses 154A facilitate such passage in the otherwise planar surface 159 on an underside surface of rear section 150.

Figure 8A:
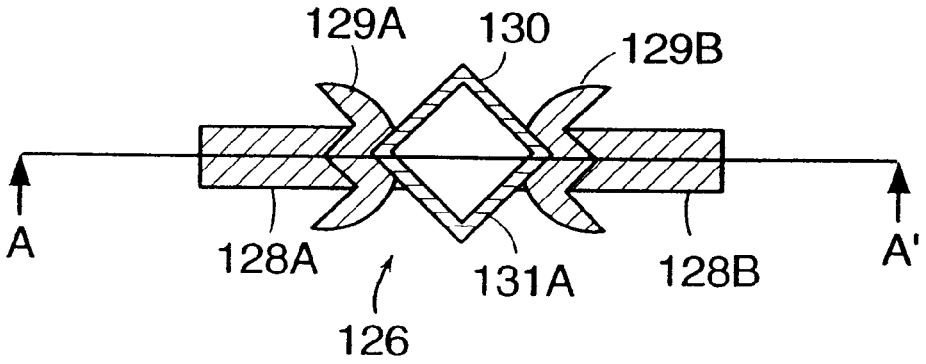
Figure 8B:
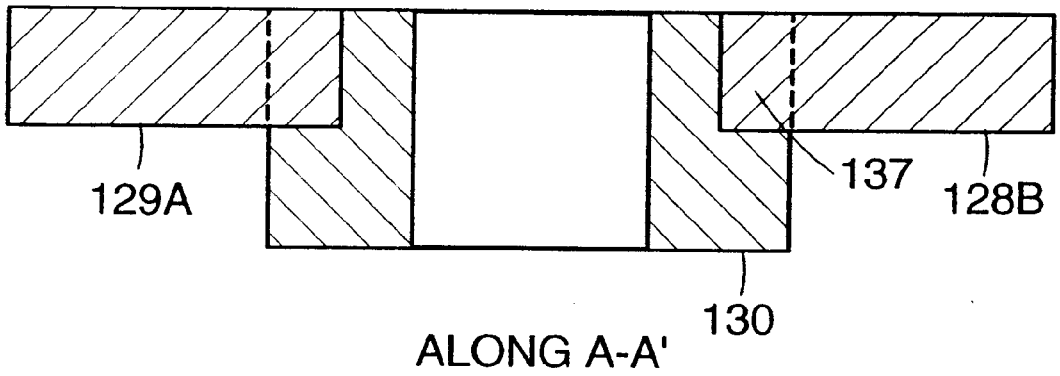

FIGS. 8A–B show the control mechanism 126 in more detail. The mechanism includes two pin portions 128A,B. At a proximal end of each is a crescent-shaped section 129A,B with outward facing teeth. A rectangular recess (shown by dashed lines 137) is defined into a proximal end of the pin, crescent combination. The recess 137 is shaped to receive a corner of rhombus-shaped biasing member 130. The rhombus shape and the orientation of biasing member 130 along with its reduced thickness walls 131 and polymeric construction allow the member 130 to be deformed and compress when rod members 128A, B are urged inward toward one another. In a preferred embodiment, a pin, e.g., 128A, and a toothed-crescent, e.g., 129A, are one piece of molded polymeric material, and biasing member 130 is a separate piece. This facilitates the placement and assembly of the control mechanism 126 within chamber 149 of front section 140 with the pins extending through grooves 127 and openings 154. Once so placed, extension caps 128C,D are placed over rods 128A,B to facilitate usage thereof.

By placing the control assembly within the toothed-walled chamber of front section 140, the natural state of the biasing member 130 causes the toothed crescents 129A,B to be forced outwardly and to engage teeth of the toothed walls 142. Then by pressing the pins 128A,B inward, biasing member 130 deforms; the teeth on the crescents 129A,B disengage the toothed-walls 142; and the front section 140 may be moved relative to the rear section 150.

The alternative inner assembly 122 may be used in shoes like those described above except the screw port 31 is unnecessary with this assembly 122 and instead ports are needed to allow pin extensions 128C,D to be accessible for manual urging.

Moreover, though the alternative inner assembly 122 is shown with two oppositely placed pins, persons skilled in the art will appreciate that this number may vary. For example, only one pin may be used with the deformable member 130 being placed against a rigid wall of the chamber. Alternatively, more pins may be used, e.g., 3 or 4.

In a preferred embodiment indicia are marked on one of the sections of the inner assembly 22, 122. For example, shoe size markings (absolute or relative) may be placed in areas 190 or 200 and viewed through plastic viewports placed in the sole of the shoe. The plastic may provide magnification if desirable.

Figure 9A:
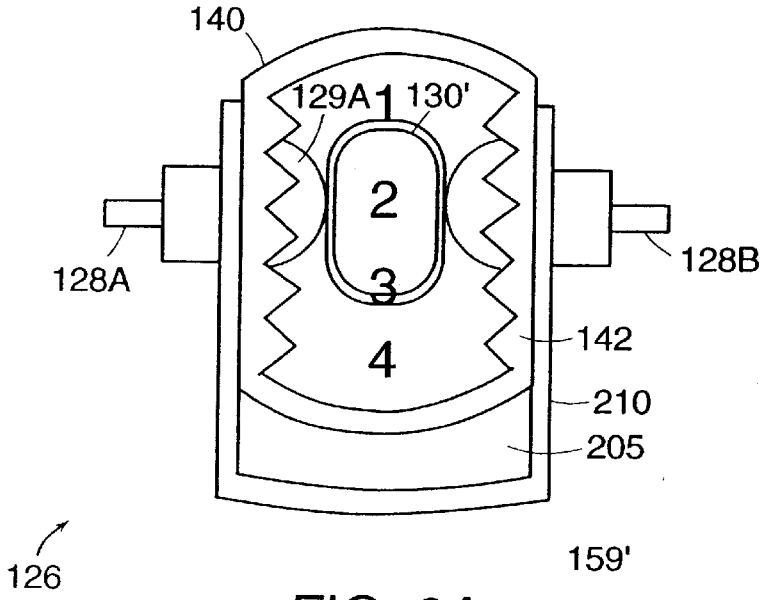
FIGS. 9A–B show exemplary embodiments of the invention in which a view port may be used to show indicia of a shoe adjustment.

FIG. 9A shows relevant portions of an exemplary embodiment having indicia in area 190 as well as showing an alternative embodiment of biasing member 130' (in this case shaped like an oval). Indica 210 can be marked with absolute or relative markings indicative of the adjustment that may be made. In the illustrated embodiment, the numeral "2" is indicative of the adjustment corresponding to the displacement 205 between the illustrated portions of front section 140 and rear section 150. The indicia are marked on the front section 140 (for example by marking a plastic wall or adding a marked label to chamber 149) and are caused to move relatively to the rear section of the shoe as the shoe is adjusted.

Figure 9B:
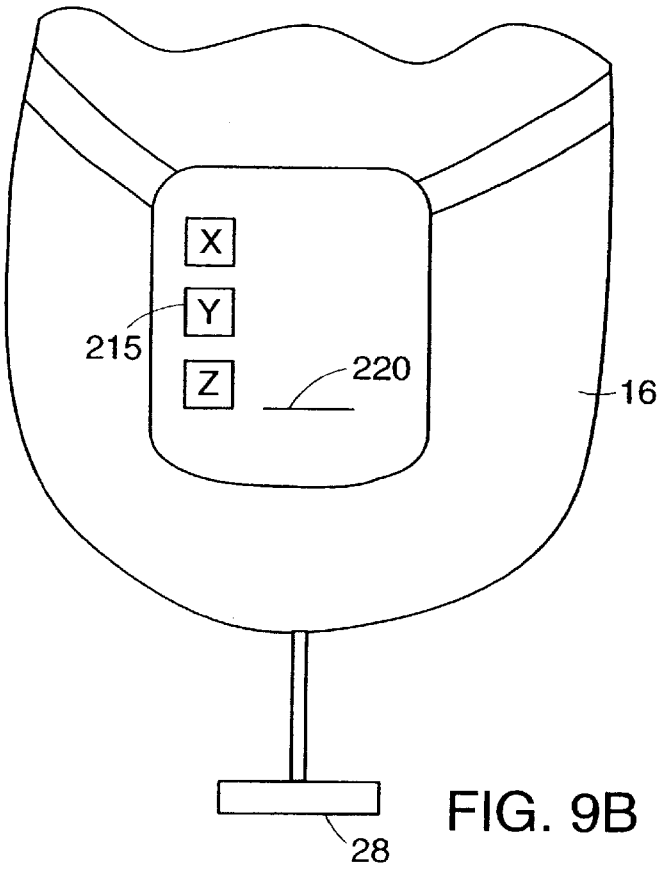

FIG. 9B shows an alternative embodiment for a screw-type embodiment. In this case, the markings 215 are placed in the rear section, and the hash mark 220 for example may be placed on control member 24 (see FIG. 3).

Persons skilled in the art will appreciate that the indicia may be placed in various parts of the shoe, and that the movement may be indirect. For example, a marked tape connected to the front section 140 may be shown through a view port in a vertical portion of the heal of the shoe.

In all of the embodiments described, the controls are easily accessible through the outer shell and not requiring access through the bottom portion of a sole. In some embodiments the adjustments may be made without any tools. All adjustments were relatively fine-grained, and size may be increased or decreased.

Preferred embodiments of the invention are described with particular reference to a hiking shoe design. Other embodiments entail other shoe constructions, including running shoes, biking shoes, ski boots, dress shoes, snow boarding boots, sandals and the like. Depending on the shoe type, the inner assembly may be in the form of a last board, or a combination of a last board and a midsole. Likewise, depending on the shoe type, the materials used will be selected to provide a desired amount of flexibility or rigidity. Moreover, depending on the shoe design the outer shell may differ. In the case of a sandal, for example, one of the novel last boards may be used, but the outer shell would only have strapping. Other embodiments, such as a biking shoe, might have either netting, meshing, or no material where the bellows are shown, thus providing increased ventilation. In short, the outer shell design offers wide latitude though the bellows embodiments shown are believed novel and advantageous in some embodiments.

In other embodiments, the screw ports and conduits for rod members may be positioned in many other areas. Likewise, though the embodiments included the control mechanisms, such as the screws, screw receiving sections, gears and deformable teeth in a rear portion of the shoe, these features may be positioned at other portions as well.

Moreover, the above embodiments described a flexible segment made of a bellows-shaped material, but other embodiments may use other materials, e.g., stretchable nylon, netting or meshing, or it may be omitted. Likewise all of the control features described had external features to activate the control, but other embodiment (e.g., cost-reducing embodiments or embodiments where hiding the control is desirable) may place the control mechanisms on the interior of the outer shell.

While the invention has been described in connection with certain preferred embodiments, it will be understood that it is not intended to limit the invention to those particular embodiments. On the contrary, it is intended to cover all alternatives, modifications and equivalents as may be included in the appended claims. Some specific components, figures and types of materials are mentioned, but it is to be understood that such component values, dimensions and types of materials are, however, given as examples only and are not intended to limit the scope of this invention in any manner.

What is claimed is:

1. An expandable shoe, comprising:

a front outer assembly;

a rear outer assembly;

an expandable segment attached to the front and rear outer assemblies to define a shoe outer shell wherein the expandable segment extends at least partially along each side of the outer shell and transversely across the bottom of the outer shell; and an adjustable inner assembly, disposed within the outer shell and attached to the front and rear outer assembly, the inner assembly having a first board portion and a second board portion in overlapping engagement with each other and a control to adjust the position of the first board portion relative to the second board portion and to thereby adjust a dimension of the inner assembly and thereby a corresponding dimension of the shoe.

2. The shoe of claim 1 wherein the expandable segment is a bellows-shaped segment.

3. The shoe of claim 1 wherein the control indudes an activation mechanism, accessible through the outer shell, to manipulate the control.

4. An expandable shoe, comprising:

a front outer assembly;

a rear outer assembly;

an expandable segment attached to the front and rear outer assemblies to define a shoe outer shell wherein the flexible segment extends at least partially along each side of the outer shell and transversely across the bottom of the outer shell; and an adjustable inner assembly, disposed within the outer shell and attached to the front and rear outer assembly, the inner assembly having a control to adjust a dimension of the inner assembly and thereby a corresponding dimension of the shoe wherein the inner assembly includes a first board portion and a second board portion, each shaped for relative movement with respect to the other; and a manual adjustment assembly having a portion thereof manually accessible from the outer shell and another portion thereof engageable with an engagement member fixed to one of the first and second board portions, wherein the engagement member is translationally movable to at least one of two states, in which a first state allows the first and second board portions to be moved relative to each other to adjust a dimension of the shoe and wherein the second state inhibits such movement.

5. The shoe of claim 4 wherein one of the first and second board portions includes a toothed segment and wherein the manual adjustment assembly includes a rod segment manually accessible from the outer shell;

a toothed member and a deformable member in a biasing relationship to position the toothed member into a lock state with the toothed segment when the deformable member is in a relaxed state and into an unlocked state when the deformable member is in a deformed state.

6. The shoe of claim 4 wherein one of the first and second board portions includes a toothed segment having a first and a second set of inward facing teeth, the first set of teeth facing the second set, and wherein the manual adjustment assembly includes a first rod segment, at least a portion of which is external to a first surface of the outer shell, a second rod segment, at least a portion of which is external to a second surface of the outer shell and positioned substantially parallel to the first rod segment so that the first and second rod segments are accessible from opposite sides of the outer shell, a first toothed member, attached to the first rod member, a second toothed member, attached to the second rod member, a deformable biasing segment positioned between the first and second toothed members to bias the first and second toothed members into a lock state with the first and second sets of teeth of the toothed segment.

7. The shoe of claim 5 wherein the first board portion is toe-shaped and has an extension with a hollow area defined in the extension, wherein the extension extends away from a toe end of the first board portion and wherein the toothed segment is within the hollowed area of the extension, and wherein the second board portion is a heel-shaped segment and is shaped to slide over the extension and to receive the extension in an alignment defined by the second board portion, and wherein the extension and second board portion each define an opening through which a portion of the rod segment passes.

8. The shoe of claim 6 wherein the first board portion is toe-shaped and has an extension with a hollow area defined in the extension, wherein the extension extends away from a toe end of the first board portion and wherein the toothed segment is within the hollowed area of the extension, and wherein the second board portion is a heel-shaped segment and is shaped to slide over the extension and to receive the extension in an alignment defined by the second board portion, and wherein the extension and second board portion each define two openings, wherein a portion of the first rod segment passes through one opening of the extension and one opening of the second board portion, and wherein a portion of the second rod segment passes through the other of the two openings of the extension and the other of the two openings of the second board portion.

9. The shoe of claim 6 wherein the deformable biasing segment is made of elastomeric material and has a deformable geometry, the geometry including two engagement sections, and wherein the first and second toothed members each include a hollow for receiving a respective one of the two engagement sections.

10. The shoe of claim 8 wherein the deformable biasing segment is made of elastomeric material and has a deformable geometry, the geometry including two engagement sections, and wherein the first and second toothed members each include a hollow for receiving a respective one of the two engagement sections.

11. The shoe of claim 1 wherein one of the first and second board portions includes an indicator bearing indicia of the adjustable dimension of the shoe and wherein the shoe further comprises a visualization window in alignment with the indicator.

12. The shoe of claim 11 wherein the visualization window provides a magnification factor.

13. The shoe of claim 4 further comprising a visualization window and an indicator in optical alignment with the window and in fixed relationship to one of the first and second board portions, the other of the first and second portions bearing indicia of the adjustable dimension of the shoe.

14. The shoe of claim 13 wherein the indicia is a shoe size.

15. The shoe of claim 13 wherein the indicia is a relative shoe size.

16. The shoe of claim 13 wherein the indicia is of a shoe dimension.

17. An adjustable last board, comprising:

a first portion and a second portion, each shaped for relative movement with respect to the other; and a manual adjustment assembly having a portion thereof shaped for manual engagement thereof and another portion thereof engageable with an engagement member that is fixed to one of the first and second portions, wherein the engagement member is translationally movable to one of at least two states, in which a first state allows the first and second portions to be moved relative to each other and wherein the second state inhibits such movement;

wherein one of the first and second board portions includes a toothed segment and wherein the manual adjustment assembly includes a rod segment shaped for manual engagement thereof;

a toothed member and a deformable member in a biasing relationship to position the toothed member into a lock state with the toothed segment when the deformable member is in a relaxed state and into an unlocked state when the deformable member is in a deformed state.

18. The last board of claim 17 wherein one of the first and second board portions includes a toothed segment having a first and a second set of inward facing teeth, the first set of teeth facing the second set, and wherein the manual adjustment assembly includes a first rod segment, at least a portion of which is shaped for manual engagement thereof, a second rod segment, at least a portion of which is shaped for manual engagement thereof and positioned substantially parallel to the first rod segment, a first toothed member, attached to the first rod member, a second toothed member, attached to the second rod member, a deformable biasing segment positioned between the first and second toothed members to bias the first and second toothed members into a lock state with the first and second sets of teeth of the toothed segment.

19. The last board of claim 17 wherein the first board portion is toe-shaped and has an extension with a hollow area defined in the extension, wherein the extension extends away from a toe end of the first board portion and wherein the toothed segment is within the hollowed area of the extension, and wherein the second board portion is a heel-shaped segment and is shaped to slide over the extension and to receive the extension in an alignment defined by the second board portion, and wherein the extension and second board portion each include an opening e and wherein a portion of the rod segment passes through the opening of the extension and the opening of the second board portion.

20. The last board of claim 17 wherein the first board portion is toe-shaped and has an extension with a hollow area defined in the extension, wherein the extension extends away from a toe end of the first board portion and wherein the toothed segment is within the hollowed area of the extension, and wherein the second board portion is a heel-shaped segment and is shaped to slide over the extension and to receive the extension in an alignment defined by the second board portion, and wherein the extension and second board portion each include two openings and wherein a portion of the first rod segment passes through one opening of the extension and one opening of the second board portion, and wherein a portion of the second rod segment passes through the other of the two openings of the extension and the other of the two openings of the second board portion.

21. The last board of claim 17 wherein the deformable biasing segment is made of elastomeric material and has a deformable geometry, the geometry including two engagement extensions, and wherein the first and second toothed members each include a hollow for receiving a respective one of the two engagement extensions.

22. The shoe of claim 20 wherein the deformable biasing segment is made of elastomeric material and has a deformable geometry, the geometry including two engagement extensions, and wherein the first and second toothed members each include a hollow for receiving a respective one of the two engagement extensions.

23. An expandable shoe, comprising:

an outer shell; and an adjustable inner assembly, disposed within the outer shell, the inner assembly forming a last board having a first board portion and a second board portion, each shaped for relative movement with respect to the other; and a manual adjustment assembly having a portion thereof manually accessible from the outer shell and another portion thereof engageable with an engagement member fixed to one of the first and second board portions, wherein the engagement member is translationally urgable to at least one of two states, in which a first state allows the first and second board portions to be moved relative to each other to adjust a dimension of the shoe and wherein the second state inhibits such movement;

wherein one of the first and second board portions includes a toothed segment and wherein the manual adjustment assembly includes a rod segment manually accessible from the outer shell;

toothed member and a deformable member in a biasing relationship to position the toothed member into a lock state with the toothed segment when the deformable member is in a relaxed state and into an unlocked state when the deformable member is in a deformed state.

24. The shoe of claim 23 wherein one of the first and second board portions includes a toothed segment having a first and a second set of inward facing teeth, the first set of teeth facing the second set, and wherein the manual adjustment assembly includes a first rod segment, at least a portion of which is external to a first surface of the outer shell, a second rod segment, at least a portion of which is external to a second surface of the outer shell and positioned substantially parallel to the first rod segment so that the first and second rod segments are accessible from opposite sides of the outer shell, a first toothed member, attached to the first rod member, a second toothed member, attached to the second rod member, a deformable biasing segment positioned between the first and second toothed members to bias the first and second toothed members into a lock state with the first and second sets of teeth of the toothed segment.

* * * * *